US009813799B2

(12) United States Patent
Gecawicz et al.

(10) Patent No.: US 9,813,799 B2
(45) Date of Patent: Nov. 7, 2017

(54) MODULAR HEADSET WITH PIVOTABLE BOOM AND SPEAKER MODULE

(71) Applicants: Raymond Gecawicz, Acton, MA (US); William Kyle, Reading, MA (US)

(72) Inventors: Raymond Gecawicz, Acton, MA (US); William Kyle, Reading, MA (US)

( * ) Notice: Subject to any disclaimer, the term of this patent is extended or adjusted under 35 U.S.C. 154(b) by 0 days.

(21) Appl. No.: 14/988,220

(22) Filed: Jan. 5, 2016

(65) Prior Publication Data

US 2016/0198254 A1 Jul. 7, 2016

Related U.S. Application Data

(60) Provisional application No. 62/100,027, filed on Jan. 5, 2015.

(51) Int. Cl.

| | |
|---|---|
| ***H04R 1/10*** | (2006.01) |
| ***H04R 5/033*** | (2006.01) |
| ***H04R 1/08*** | (2006.01) |

(52) U.S. Cl.

CPC ..... *H04R 1/1041* (2013.01); *H04R 1/083* (2013.01); *H04R 1/1008* (2013.01); *H04R 1/1058* (2013.01); *H04R 5/033* (2013.01)

(58) Field of Classification Search

CPC .. H04R 1/1008; H04R 1/1041; H04R 1/1066; H04R 2201/107; H04R 2201/109; H04M 1/05; H04M 1/6058

See application file for complete search history.

(56) References Cited

U.S. PATENT DOCUMENTS

| | | | |
|---|---|---|---|
| 2,403,418 | A | 7/1946 | Volkmann |
| 4,302,635 | A | 11/1981 | Jacobsen et al. |

(Continued)

FOREIGN PATENT DOCUMENTS

| | | |
|---|---|---|
| CN | 202261746 | 5/2012 |
| WO | WO 2012084032 | 6/2012 |

OTHER PUBLICATIONS

U.S., International Search Report and Written Opinion,PCT/ISA/220, Application No. PCT/US2016/012165, dated Mar. 30, 2016, U.S. Patent & Trademark Office, Alexandria, VA.

*Primary Examiner* — Matthew Eason

(74) *Attorney, Agent, or Firm* — Thomas P. O'Connell; O'Connell Law Firm

(57) ABSTRACT

A modular headset with a microphone boom module selectively engageable with a headband module. The microphone boom module has a speaker housing, a microphone boom, a microphone retained by the microphone boom, and a speaker retained by the speaker housing. An annular hub projects from the speaker housing, and an aperture is disposed in the headband module for receiving the hub in a pivotable engagement. Positive and negative electrical contact surfaces, such as conductive rings, are disposed over the hub, and electrical contacts project from the aperture to travel along the electrical contact surfaces. The microphone boom module has an active angular zone $Z_a$ wherein the microphone boom module is active and a mute angular zone $Z_m$. The mute angular zone $Z_m$ can include a range of angles encompassing alignment of a longitudinal orientation of the microphone boom module with a plane of the headband.

23 Claims, 19 Drawing Sheets

(56) References Cited

U.S. PATENT DOCUMENTS 4,418,248 A 11/1983 Mathis
4,472,607 A 9/1984 Houng
4,499,593 A 2/1985 Antle
4,634,816 A 1/1987 O'Malley et al.
4,689,822 A 8/1987 Houng
4,875,233 A * 10/1989 Derhaag ..... H04M 1/05 379/430
5,018,599 A 5/1991 Dohi et al.
5,197,332 A 3/1993 Shennib
5,381,486 A 1/1995 Ludeke et al.
5,446,788 A 8/1995 Lucey et al.
5,469,505 A 11/1995 Gattey et al.
D366,486 S 1/1996 Runquist et al.
5,504,812 A * 4/1996 Vangarde ..... H04M 1/6058 379/430
5,555,554 A 9/1996 Hofer et al.
5,579,400 A 11/1996 Ballein
D377,020 S 12/1996 Bungardt et al.
5,793,878 A 8/1998 Chang
5,832,098 A 11/1998 Chen
5,890,074 A 3/1999 Rydbeck et al.
D410,921 S 6/1999 Luchs et al.
6,016,347 A * 1/2000 Magnasco ..... H04R 1/1041 379/430
6,075,857 A 6/2000 Doss, Jr. et al.
6,078,825 A 6/2000 Hahn et al.
6,101,260 A 8/2000 Jensen et al.
6,230,029 B1 5/2001 Hahn et al.
D443,870 S 6/2001 Carpenter et al.
D449,035 S 10/2001 Weikel et al.
D451,903 S 12/2001 Amae et al.
D451,906 S 12/2001 Amae et al.
D451,907 S 12/2001 Amae et al.
6,356,635 B1 3/2002 Lyman et al.
6,359,995 B1 3/2002 Ou
6,373,942 B1 4/2002 Braund
6,374,126 B1 4/2002 MacDonald, Jr. et al.
6,466,681 B1 10/2002 Siska, Jr. et al.
D482,019 S 11/2003 Petersen et al.
D494,154 S 8/2004 Polito
D498,470 S 11/2004 Skulley et al.
D504,883 S 5/2005 Jacobson et al.
D517,528 S 3/2006 Skulley
D530,307 S 10/2006 Rath
D530,702 S 10/2006 Pritchard et al.
D531,165 S 10/2006 Rath
D538,785 S 3/2007 Skulley
D540,778 S 4/2007 Thompson et al.
D542,774 S 5/2007 Rausch
D549,216 S 8/2007 Viduya et al.
D549,694 S 8/2007 Viduya et al.
D567,219 S 4/2008 Viduya et al.
D567,799 S 4/2008 Viduya et al.
D567,806 S 4/2008 Viduya et al.
7,391,863 B2 * 6/2008 Viduya ..... H04M 1/05 379/430
D589,934 S 4/2009 Esses
D597,072 S 7/2009 Asai
D601,543 S 10/2009 Bentley
D602,001 S 10/2009 Bentley
D602,002 S 10/2009 Asai
D605,629 S 12/2009 Suwalski et al.
D613,267 S 4/2010 Suwalski et al.
D616,419 S 5/2010 Suwalski et al.
D628,189 S 11/2010 Rath
D635,548 S 4/2011 Kelley
D638,000 S 5/2011 Hoggarth
D640,666 S 6/2011 Wahl
D641,337 S 7/2011 Brandis
D645,023 S 9/2011 Brandis
8,061,473 B1 11/2011 Kerr
D653,649 S 2/2012 Yang et al.
8,160,287 B2 4/2012 Slippy et al.
D666,168 S 8/2012 Rath
D668,240 S 10/2012 Brandis
8,331,603 B2 * 12/2012 Martenson ..... H04M 1/05 379/430
D673,523 S 1/2013 Brennwald
D673,524 S 1/2013 Brennwald
D681,004 S 4/2013 Kelley
D684,145 S 6/2013 Rath
8,724,825 B2 * 5/2014 Birch ..... H04R 1/083 381/370
D712,875 S 9/2014 Katori et al.
8,842,849 B2 * 9/2014 Wahl ..... H04M 1/05 381/370
D716,258 S 10/2014 Awiszus et al.
D716,762 S 11/2014 Greve
8,897,479 B2 * 11/2014 Birch ..... H04M 1/6058 381/367
D719,135 S 12/2014 Kelley
D723,511 S 3/2015 Pedersen
D724,562 S 3/2015 Sparks et al.
D731,458 S 6/2015 Goransson
D732,002 S 6/2015 Goransson
D732,503 S 6/2015 Brunner et al.
D733,677 S 7/2015 Ling et al.
2001/0017925 A1 8/2001 Ceravolo
2001/0017926 A1 8/2001 Vicamini
2001/0036291 A1 11/2001 Pallai
2002/0009191 A1 1/2002 Lucey et al.
2002/0085733 A1 7/2002 Cottrell
2002/0131616 A1 9/2002 Bronnikov et al.
2003/0068061 A1 4/2003 Huang
2004/0190745 A1 9/2004 Chen
2004/0264720 A1 12/2004 Huang
2006/0140435 A1 * 6/2006 Sheehy ..... H04R 1/1041 381/390
2007/0223766 A1 9/2007 Davis et al.
2010/0158264 A1 * 6/2010 Marten ..... H04R 1/1041 381/74
2012/0020491 A1 * 1/2012 Dory ..... H04R 1/1041 381/74
2012/0163616 A1 6/2012 Birch
2012/0328119 A1 12/2012 Heise
2013/0022225 A1 * 1/2013 Chiang ..... H04R 1/1075 381/371
2013/0329905 A1 12/2013 Awiszus et al.
2014/0003646 A1 * 1/2014 Andersen ..... H04R 1/08 381/375

* cited by examiner

MODULAR HEADSET WITH PIVOTABLE BOOM AND SPEAKER MODULE

FIELD OF THE INVENTION

The present invention relates generally to audio communication headsets. Stated more particularly, disclosed herein is a modular headset for audio communication with modular components and a selectively pivotable microphone boom and speaker module.

BACKGROUND OF THE INVENTION

Audio communication headsets typically have a microphone and either one or two earphones. The microphone is commonly retained by a boom or a mouthpiece. For headsets having two earphones, the earphones may be connected by, for instance, a headband or a neckband. Audio is provided from one earphone to the other by an electrical connection between the earphones. Wireless headsets may communicate with a wireless communication hub while wired headsets may have a wire for connecting to an external system, such as a telephone system or a computer.

During use of a headset, it may be desirable to adjust the position of the microphone boom. For instance, a user may seek to move the boom to a desired use position or to a non-use position. A user may also wish to reconfigure the headset for use relative to a given ear as compared to the other.

However, with wires typically passing from the microphone boom and earphone and through or at least into the headband, the joint between the headband and the microphone boom and earphone is often a fixed joint. With that, it is difficult or impossible for a user to adjust the headset to a desired orientation for use or to permit selective application of the headset to one ear or the other.

The prior art has disclosed a number of adjustable boom headset constructions. Adjustable headsets are known with mechanical stops that seek to restrict the movement of the microphone boom while others, such as that disclosed in EP 2 178 275, provide microphone booms that are fully rotatable. United States Application Publication No. 2012/0328119 of Heise also seeks to provide 360-degree rotation of the joint between an earphone unit and a connecting band through an inductive connection therebetween.

Even the combined prior art relating to adjustable headsets has left a number of disadvantages. By way of example and not limitation, previously disclosed headsets often do not permit users to adjust a microphone boom to a given angle and then reliably and effectively lock it in position. Headsets of the prior art also are commonly delicate and prone to malfunction and breakage. Still further, many of the adjustable headsets of the prior art are complex in structure and operation. Where headsets are adjustable, the adjustment mechanisms often are prone to failure or poor performance such that consistently maintaining a desired, properly functioning position is prevented. Even further, adjustable headsets of the prior art often do not provide modularity of the headset components. As a result, users are fundamentally limited in their options for, among other things, component characteristics, repair, and maintenance.

SUMMARY OF THE INVENTION

In view of the state of the art and the limitations and deficiencies of current headsets as summarized above, the present inventors set forth with an object of providing a headset with modular components.

In particular embodiments, an alternative or additional object of the invention is to provide a headset with a selectively pivotable microphone boom and speaker module.

A more particular object of embodiments the invention is to provide a headset with a pivotable microphone boom and speaker module that can rotate along a single axis relative to a headband module permitting, by way of example and not limitation, adjustment of the microphone boom and speaker module to a desired position and allowing a user to switch from one ear to the other without losing electrical contact.

Certain manifestations of the invention have the object of providing a headset with a pivotable microphone boom and speaker module that can connect to various headband modules for both mono and stereo applications.

Embodiments of the invention have the alternative or additional object of providing a headset with a pivotable microphone boom and speaker module that can be selectively retained and secured at a given angular orientation relative to a headband module by use of a clutch mechanism operative to tighten the boom and speaker module to the headband module.

Embodiments of the invention have the object of providing a headset with first and second earphones and a pivotable microphone boom and speaker module that can be adjusted to a desired position without a loss in electrical connection between first and second earphones.

Still another object of embodiments of the invention is to provide a modular headset that allows the main battery to be removed without an immediate loss in power.

Yet another object of embodiments of the invention is to provide a headset with an electronic circuit for processing electronic signals from at least one microphone and electronic circuitry for establishing wireless or corded communication with a voice communication system.

Yet another object of embodiments of the invention is to provide a headset with a microphone boom and speaker module that can be pivoted and selectively fixed against pivoting in an ergonomic and convenient manner.

These and further objects and advantages of embodiments of the invention will become obvious not only to one who reviews the present specification but also to one who has an opportunity to make use of an embodiment of the modular headset disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In carrying forth one or more objects of the invention, an embodiment of the modular headset has a headband module and a microphone boom module that is removably and replaceably engageable with the headband module, such as in a snap-fit engagement. The microphone boom module has a microphone boom that has a proximal portion and a distal portion. A microphone is retained by the distal portion of the microphone boom. An annular hub is disposed on one of the headband module and the microphone boom module, and an aperture is disposed in the other of the headband module and the microphone boom module for selectively receiving the hub in a pivotable engagement. Positive and negative electrical contact surfaces, such as electrically conductive rings, are disposed over at least a portion of the hub or the aperture. Electrical contacts project from the other of the hub and the aperture to travel along the annular positive and negative electrical contact surfaces when the microphone boom module and the headband module are engaged with the hub received in the aperture.

In certain embodiments, the aperture can be disposed in the headband module, and the hub can be retained by the microphone boom module. Further, a speaker can be retained by the microphone boom module, such as in a speaker housing from which the microphone boom can project. The electrical contacts can be resiliently biased into contact with the annular positive and negative electrical contact surfaces.

The first and second conductive rings can be continuous to produce constant electrical communication between the microphone boom module and the headband module. In other embodiments, the microphone boom module can have an active mode where audio signals can be received by the speaker and a mute mode where audio signals are not received by the speaker.

The active and mute modes can be dependent on the angular orientation of the microphone boom module in relation to the headband module. For instance, the microphone boom module can have an first, active angular zone $Z_a$ of pivoting wherein the microphone boom module is active and a second, mute angular zone $Z_m$, of pivoting wherein the microphone boom module is rendered mute. While additional zones $Z_a$ and $Z_m$ can be provided, modular headsets according to the invention could have one active angular zone $Z_a$ and one mute angular zone $Z_m$. Further, where the microphone boom module is considered to have a longitudinal orientation and the headband module has a headband considered to be disposed generally in a plane, the mute angular zone $Z_m$ can include a range of angles encompassing alignment of the longitudinal orientation of the microphone boom module with the plane of the headband.

The active and mute angular zones $Z_a$ and $Z_m$ could be established in a number of ways within the scope of the invention. In one embodiment, at least one of the positive and negative electrical contact surfaces disposed over at least a portion of the hub or the aperture is discontinuous over a non-conductive angular portion and wherein the mute angular zone $Z_m$ is established by the non-conductive angular portion. The non-conductive angular portion could, for instance, be produced by a gap in at least one of the first and second conductive rings. For example, the first conductive ring could be continuous, and the gap could be in the second conductive ring. To permit the electrical contacts to transition smoothly between the active and mute angular zones $Z_a$ and $Z_m$, the second conductive ring can have sloped end portions contiguous with the gap.

At least one electrical contact can project from the hub or the aperture to travel along the annular positive electrical contact surface when the microphone boom module and the headband module are engaged with the hub received in the aperture, and at least one electrical contact can project from the hub or the aperture to travel along the annular negative electrical contact surface when the microphone boom module and the headband module are engaged with the hub received in the aperture. Embodiments of the modular headset are contemplated wherein at least first and second electrical contacts project from the hub or the aperture to travel along the annular positive electrical contact surface when the microphone boom module and the headband module are engaged with the hub received in the aperture and at least first and second electrical contacts project from the hub or the aperture to travel along the annular negative electrical contact surface when the microphone boom module and the headband module are engaged with the hub received in the aperture.

A locking mechanism can be provided for selectively locking the hub against pivoting relative to the aperture. The locking mechanism can derivatively lock the microphone boom module against pivoting relative to the headband module. The locking mechanism could, for instance, comprise a setscrew threadedly engaged with the aperture that selectively engages the hub.

A speaker can be retained by the microphone boom module, such as by a speaker housing. The headband can have a first end portion and a second end portion. The modular headset could be monaural with a single speaker, or it could be binaural with a second speaker. The second speaker could be retained by the second end portion of the headband in electrical communication with the first speaker, such as through a wire.

The modular headset could be corded, or power could be provided by a battery module. The battery module could, for instance, be removably and replaceably received by the microphone boom module. Moreover, a back-up battery could be disposed within the microphone boom module to provide temporary power in the event of a discharge or removal of the battery module.

One will appreciate that the foregoing discussion broadly outlines the more important features of the invention merely to enable a better understanding of the detailed description that follows and to instill a better appreciation of the inventors' contribution to the art. Before an embodiment of the invention is explained in detail, it must be made clear that the following details and descriptions of inventive concepts are mere examples of the many possible manifestations of the invention.

DETAILED DESCRIPTION OF PREFERRED EMBODIMENTS

The modular headset disclosed herein is subject to varied embodiments, each within the scope of the invention. However, to ensure that one skilled in the art will be able to understand and, in appropriate cases, practice the present invention, certain preferred embodiments of the broader invention revealed herein are described below.

Figure 1:
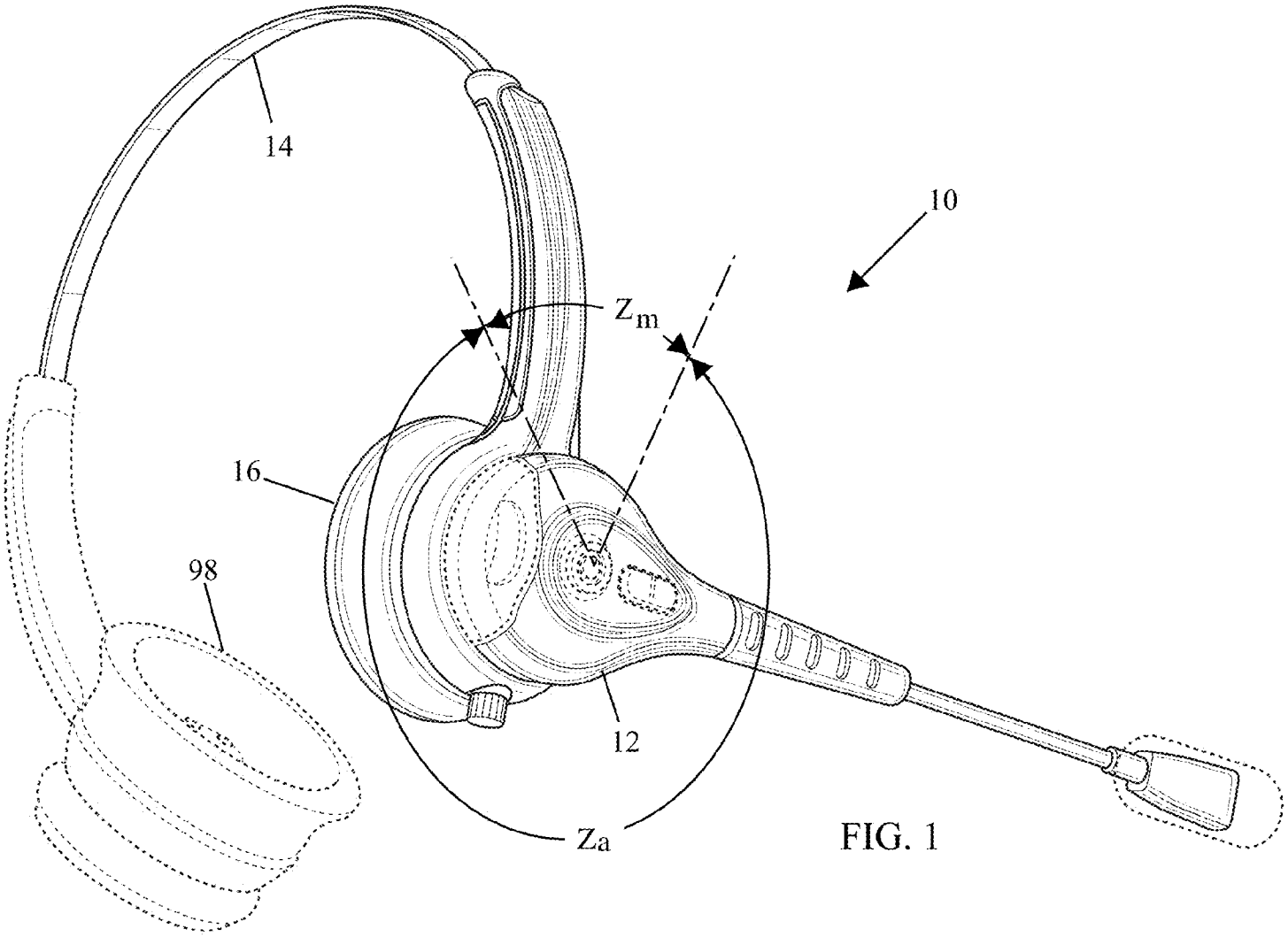
FIG. 1 is a perspective view of a binaural modular headset according to the invention.
Figure 2:
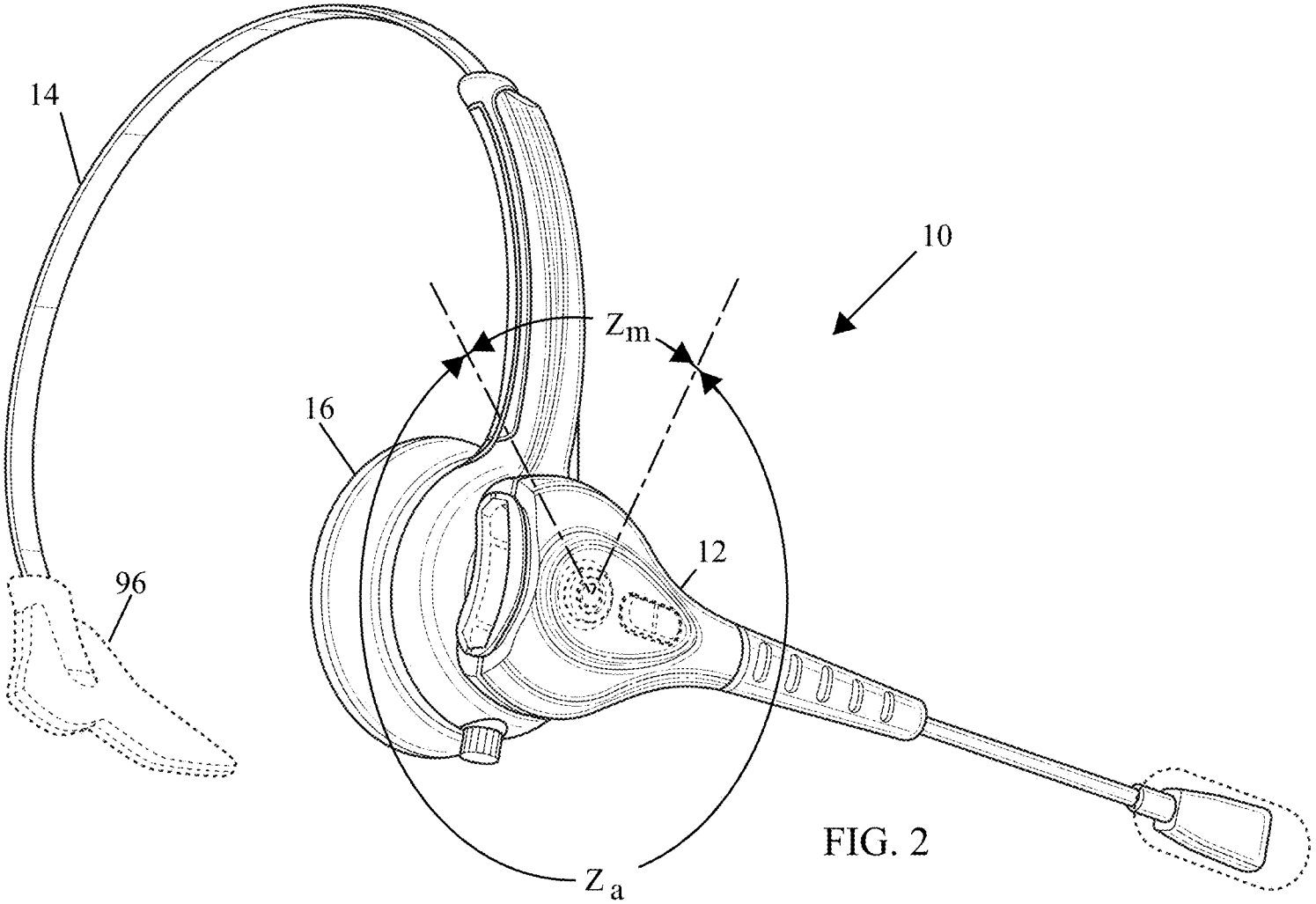
FIG. 2 is a perspective view of a monaural modular headset.
Figure 3:
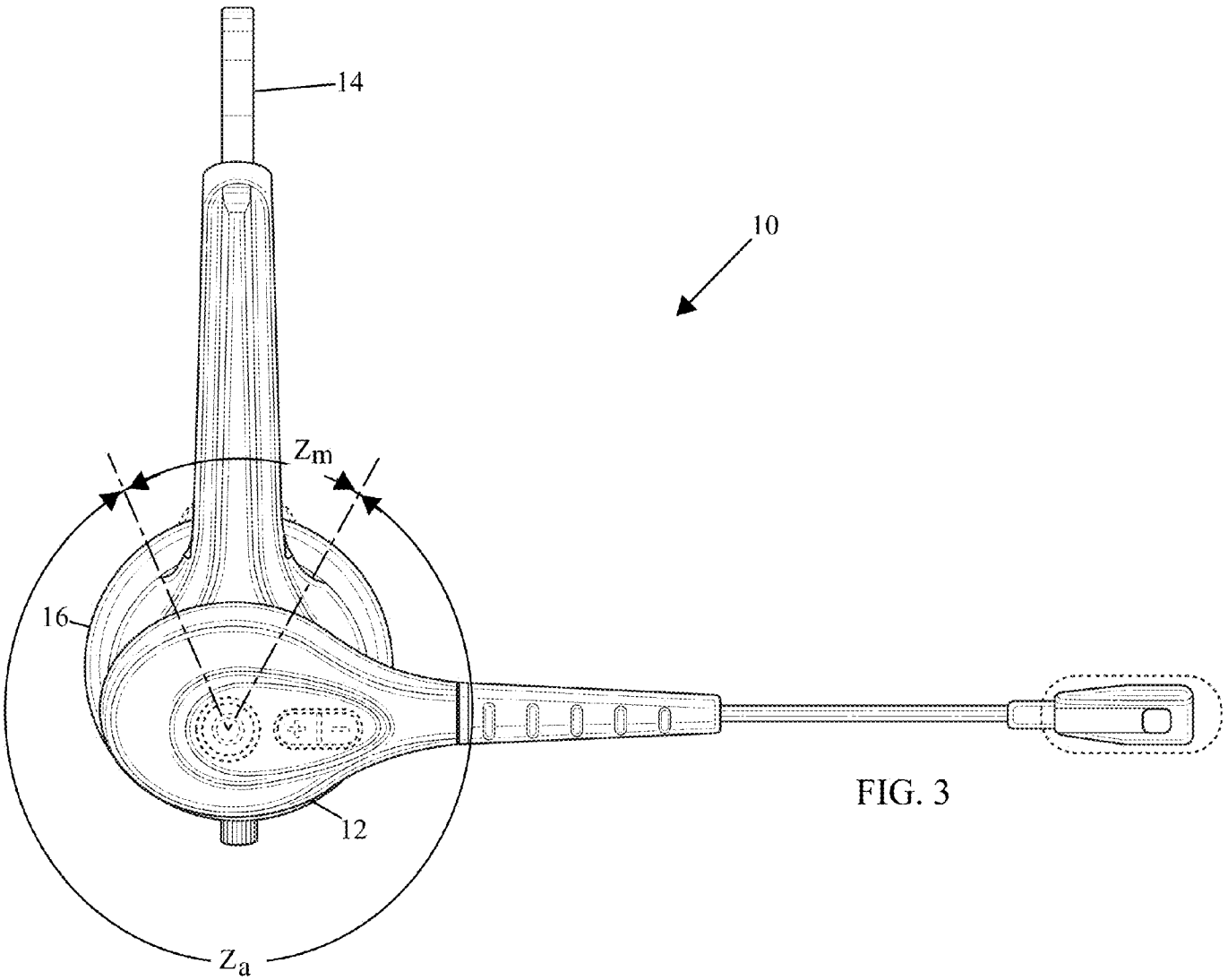
FIG. 3 is a view in side elevation of a monaural modular headset as taught herein.

Looking more particularly to the drawings, a modular headset embodying the broader invention disclosed herein is indicated generally at 10 in FIG. 1. The modular headset 10 has a speaker and microphone boom module 12 that can be pivotally engaged and retained by a headband module 14. The speaker and microphone boom module 12 has a speaker housing 26, and a microphone boom 22 projects from the speaker housing 26. As shown in FIG. 1, a removable ear cushion flange 16 can be retained, such as by the headband module 14 and, additionally or alternatively, the speaker and microphone boom module 12, for comfort and improved audio performance.

In the depicted embodiment of FIG. 1, the modular headset 10 is binaural with a second speaker assembly 98 to a second side of the headband module 14 with incoming audio signals being electrically communicated from the first speaker housing 26 to the second speaker assembly 98. The modular headset 10 of FIG. 1 is battery powered with a battery module 24 removably and replaceably received by the speaker housing 26. A back-up battery, which is described further hereinbelow, is disposed within the speaker and microphone boom module 12 of the modular headset 10 to provide temporary power in the event of a discharge or removal of the main battery module 24.

As is illustrated in FIG. 1, for instance, embodiments of the modular headset 10 can have automatic switching between an active mode where audio signals are received and transmitted by the speaker and microphone boom module 12 and an inactive or mute mode where the speaker and microphone boom module 12 are automatically deactivated and audio signals from the wearer are not received and transmitted. In the depicted embodiment, the automatic switching of the speaker and microphone boom module 12 between active mode and mute mode is dependent on the angular orientation of the speaker and microphone boom module 12 in relation to the headband module 14.

Here, the automated switching establishes a first, active angular zone $Z_a$ of pivoting wherein the speaker and microphone boom module 12 is active and a second, mute angular zone $Z_m$ of pivoting wherein the speaker and microphone boom module 12 is rendered inactive or mute. The angular ranges of the zones $Z_a$ and $Z_m$ could vary, and it would be possible to have multiples of either or both the active and inactive angular zones $Z_a$ and $Z_m$. In the depicted embodiment, the inactive angular zone $Z_m$ spans approximately 60 degrees and is centered around alignment of the longitudinal of the speaker and microphone boom module 12 with the plane of the headband module 14, and the active angular zone $Z_a$ spans the approximately 300 degrees therebetween.

Exploiting this automated switching, the details of one possible embodiment of which being described further hereinbelow, a wearer of the modular headset 10 can be provided with active audio communication when the speaker and microphone boom module 12 is oriented in any portion of the active angular zone $Z_a$, and the speaker and microphone boom module 12 can be induced to an inactive, mute mode by a pivoting of the speaker and microphone boom module 12 to a longitudinal orientation within the inactive angular zone $Z_m$.

Figure 11:
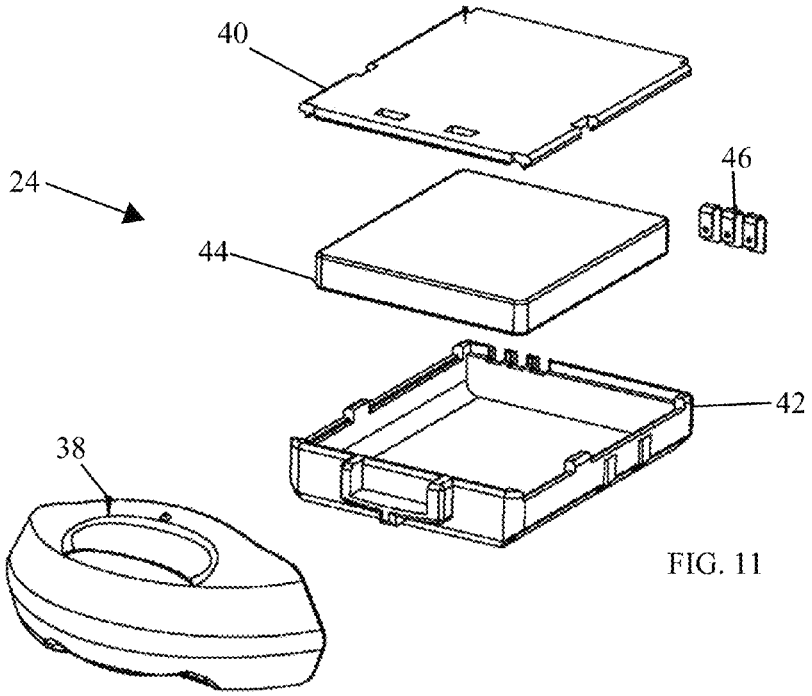
FIG. 11 is an exploded perspective view of a removable battery for the modular headset.
Figure 12:
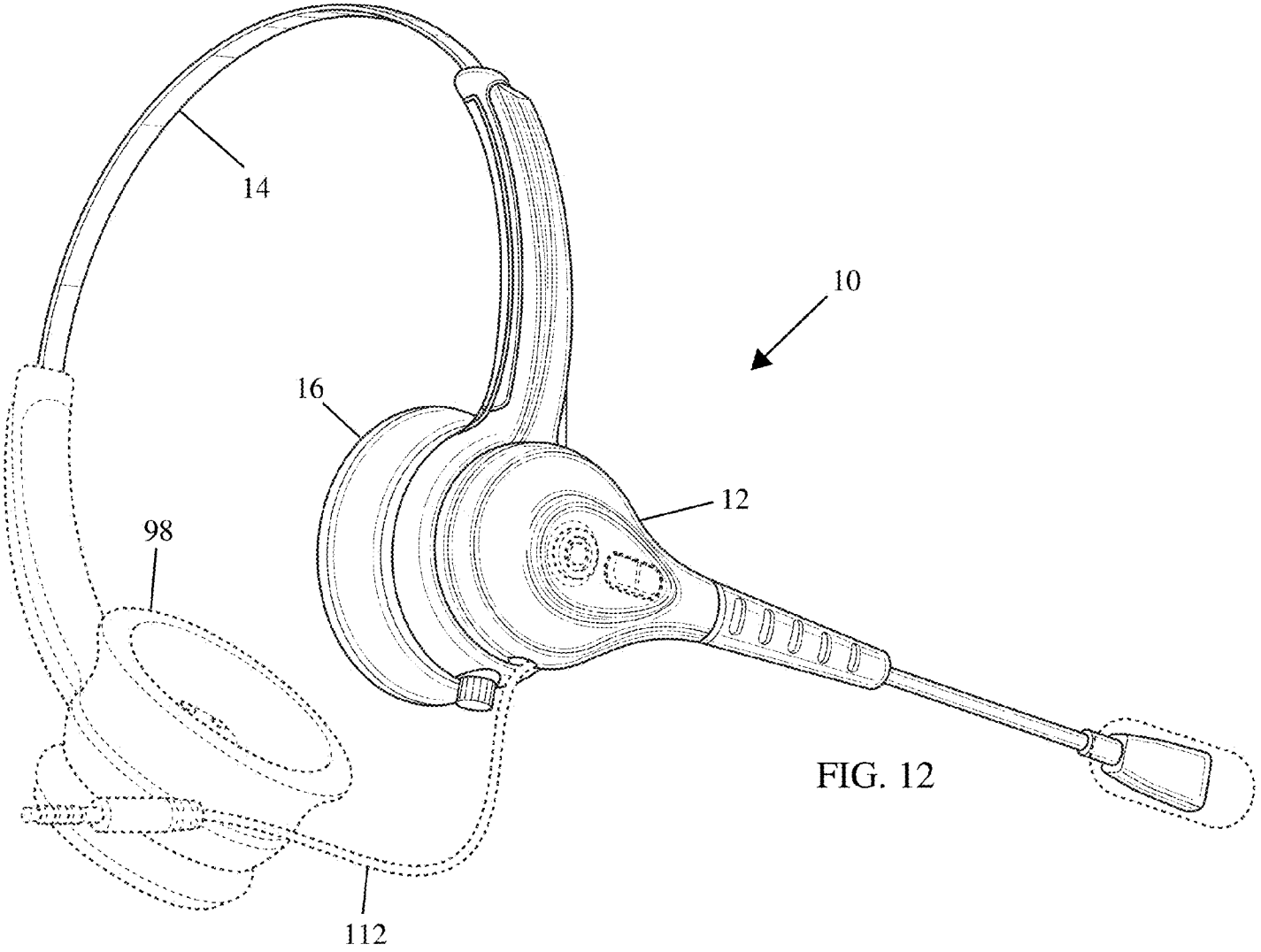
FIG. 12 is a perspective view of a binaural corded modular headset as disclosed herein.

As further shown in FIG. 11, the removable battery module 24 could be founded on a lithium-ion battery 44. The battery 44 is housed by an end cover 38 that forms an ergonomically shaped handle for the module 24, a top cover 40, and a bottom cover 42. Together, the covers 38, 40, and 42 form a battery housing. The top and bottom covers 40 and 42 combine to form an asymmetrical shape in lateral cross section. For example, as illustrated, the asymmetrical cross-sectional shape can be generally rectangular with beveled longitudinal edges along, for example, the top cover 40. Battery contact springs 46 are retained by the battery housing to provide electrical contact between the battery 44 and the electrically powered components of the modular headset 10.

Figure 4:
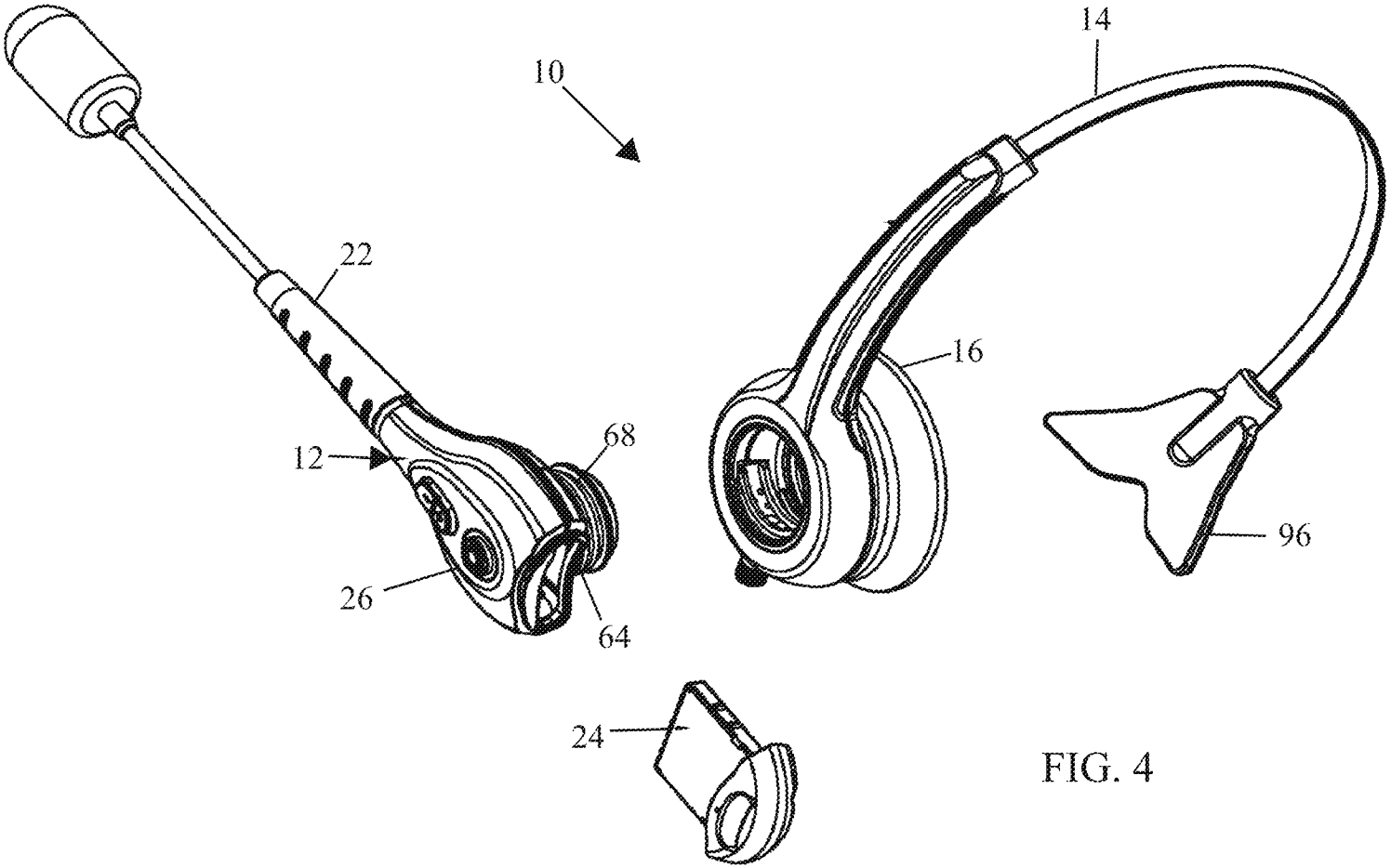
FIG. 4 is a partially exploded perspective view of a monaural modular headset.

As can be appreciated with additional reference to FIG. 4, for example, the battery housing is keyed to engage the speaker housing 26 positively. More particularly, the speaker housing 26 has a slot therein with an asymmetrical cross-sectional shape corresponding to the cross-sectional shape formed by the assembled top and bottom covers 40 and 42 of the battery module 24. With that, the battery module 24 is uni-directionally received by the speaker housing 26. Moreover, the end cover 38 has a rounded, contoured outer edge that compliments the rounded shape of the speaker housing 26 such that the battery module 24 and the speaker housing 26 form a unified, generally teardrop-shaped structure when assembled as in FIG. 1.

Figure 6:
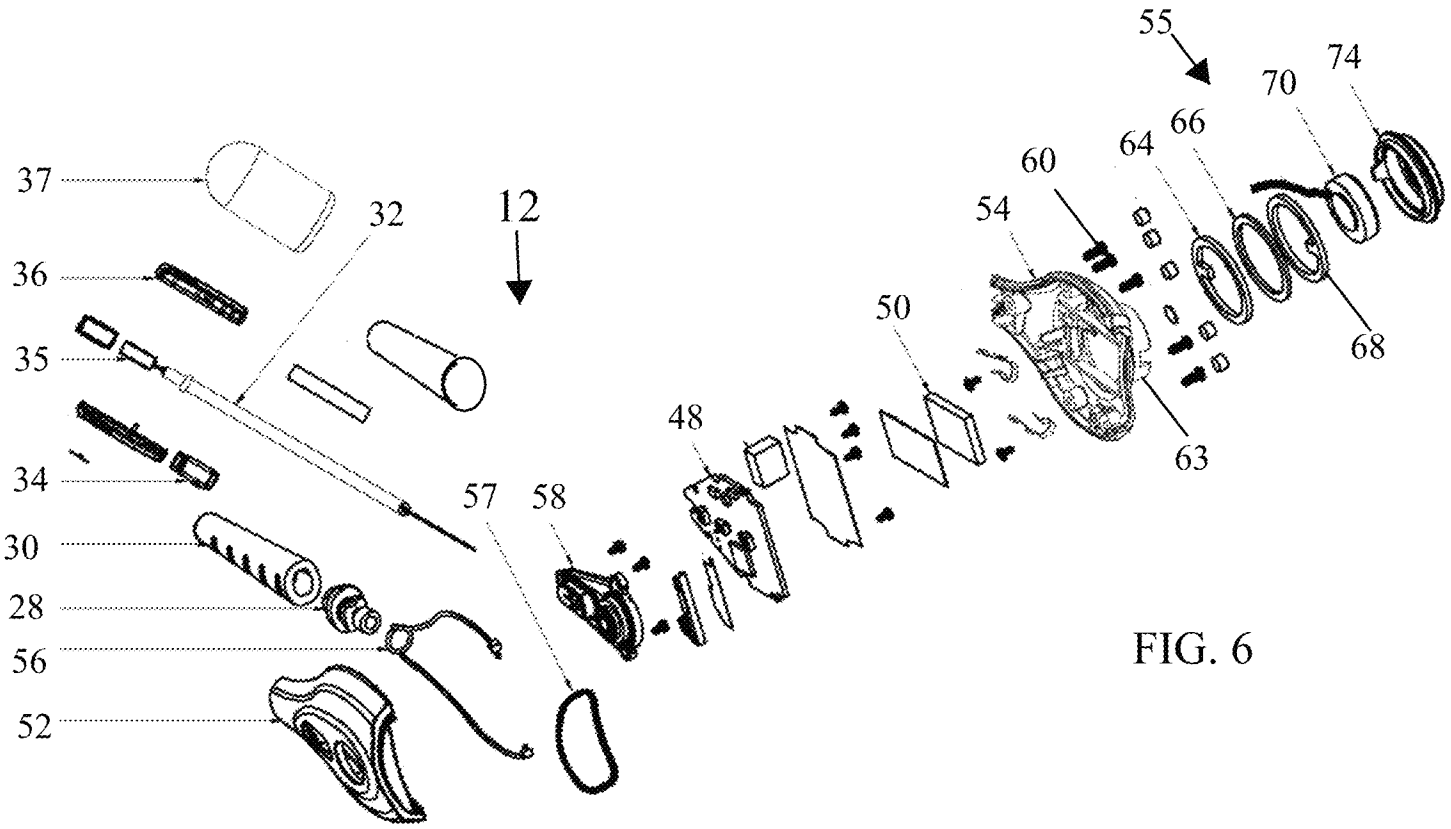
FIG. 6 is an exploded perspective view of the speaker and microphone boom assembly of a modular headset as taught herein.
Figure 7:
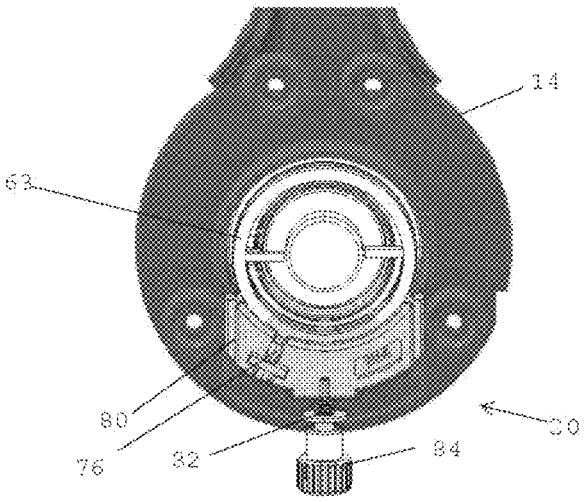
FIG. 7 is a partially sectioned view in side elevation of the angular retention mechanism.
Figure 8:
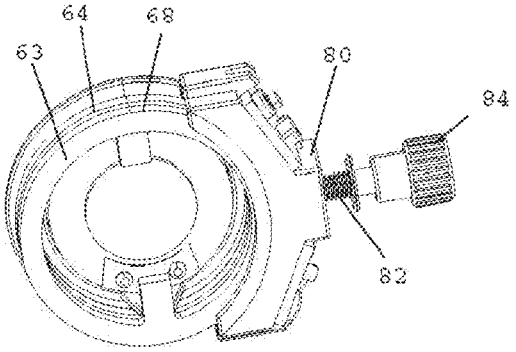
FIG. 8 is a perspective view of an angular retention mechanism for the modular headset.
Figure 9:
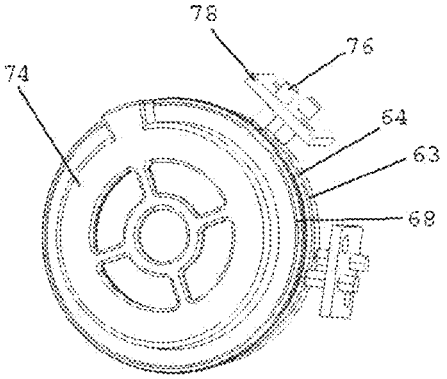
FIG. 9 is a perspective view of a sliding, rotatable electrical contact for the modular headset.
Figure 10:
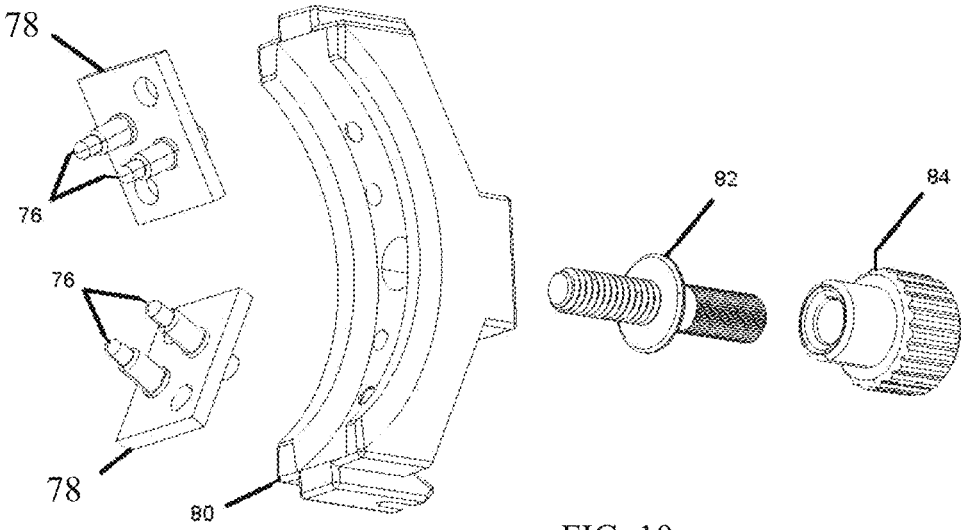
FIG. 10 is an exploded perspective view of sliding, rotatable electrical contact and angular retention mechanism components operable according to the invention.

As seen in FIG. 6, the speaker assembly 26 has a bottom cover 52 comprising a generally teardrop-shaped half shell. The bottom cover 52 has an inner portion forming roughly a first half of the slot that receives the battery module 24 at a first end thereof. The speaker assembly 26 has a top cover 54 that has a generally teardrop shaped periphery corresponding to that of the bottom cover 52. The top cover 54 has an inner portion forming roughly the second half of the slot that receives the battery module 24. The tapered tip portions of the top and bottom covers 54 and 52 cooperate to engage and retain the microphone boom 22 through a locking flex boom key 28 proximally connected to the microphone boom 22. The top cover 54 has a hub 63 that retains a speaker assembly 55.

The top cover 54 cooperates with the bottom cover 52 to define an open inner volume. A longitudinal gasket 56 is interposed between the top and bottom covers 54 and 52, and an end gasket 57 bounds the entrance of the slot for receiving the battery module 24. Together, the gaskets 56 and 57 provide insulation to the speaker assembly 26 and the open inner volume thereof from physical contamination, vibration, and other deleterious environmental and other impacts. The bottom cover 52 and the top cover 54 can be joined by any effective method, including, but not limited to, fasteners 60, a snap-fit engagement, adhesive, sonic welding, or in any other effective manner.

A back-up battery 50, which can be seen, for instance, in FIG. 6, is electrically connected to the microphone boom module 12 and the electrical components retained by the speaker housing 26 formed by the top and bottom covers 54 and 52 so that the main battery module 24 can be removed and replaced without an immediate loss in power or connectivity. A printed circuit board assembly (PCBA) 48 is retained within the open inner volume as is the back-up battery 50. The back-up battery 50 can be electrically connected to the remainder of the modular headset 10 by, for example, a flexible wire cable. A control assembly 58 with control buttons, such as volume and power buttons, is retained for access by a user, and an LED lightpipe can provide illumination.

Other embodiments of the modular headset 10 can be corded as, for example, in FIGS. 3 and 12 through 14. There, the removable battery module 24 is replaced by a power and data cord 112.

Figure 5:
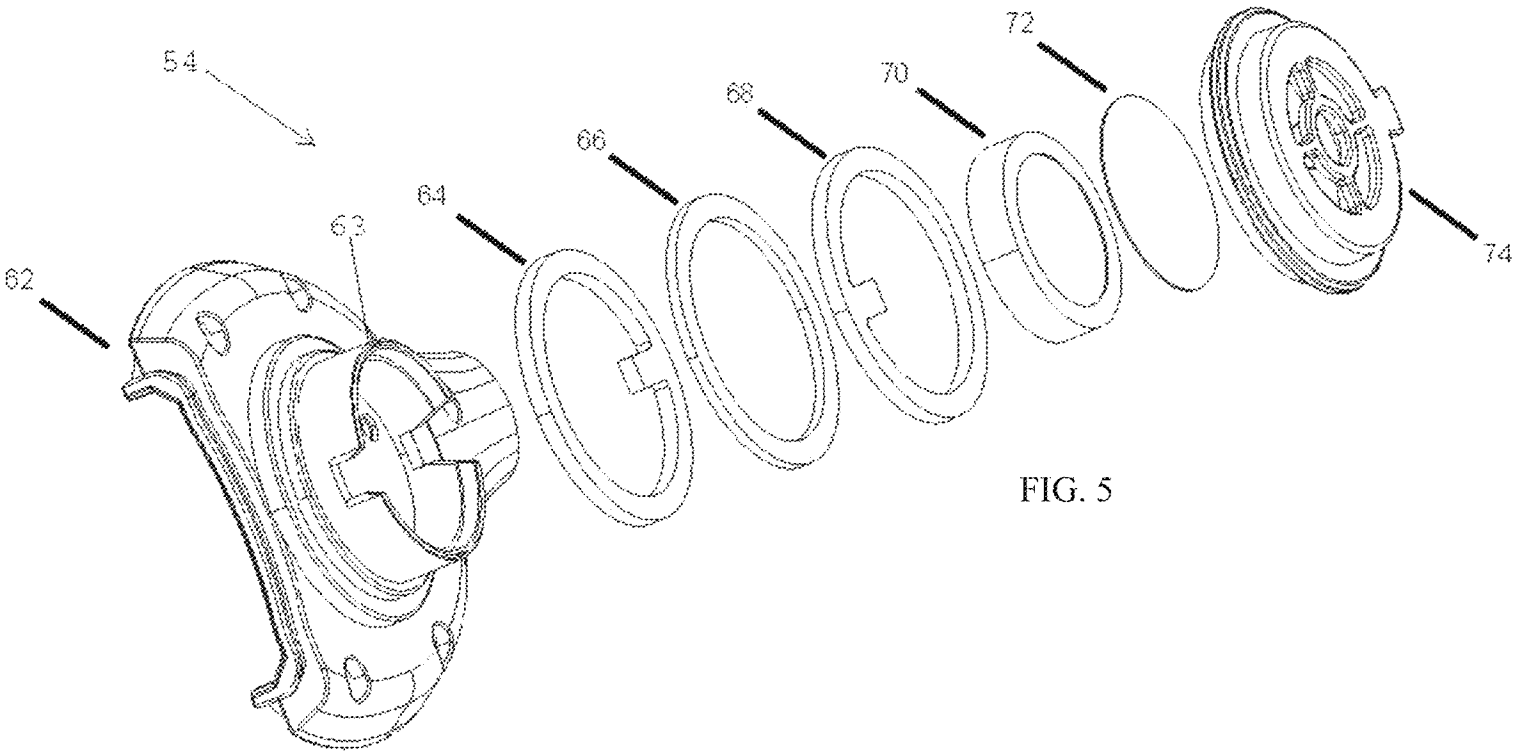
FIG. 5 is an exploded perspective view of a bottom cover and speaker assembly of a modular headset according to the invention.

The microphone boom assembly 22 can be further understood with reference to FIGS. 5 and 6. There, the microphone boom assembly 22 can be seen to include a locking flexible boom key 28 that is retained by the bottom cover 52 and the top cover 54, such as by being sandwiched in between the tapered ends thereof. A flex boom strain relief member 30 extends from the flexible boom key 28, and a flexible boom 32 extends from the flex boom strain relief member 30. A microphone housing strain relief member 34 is disposed at a distal end of the flexible boom 32. A microphone housing 36 retained at the distal end of the microphone boom assembly 22 retains a microphone 35. A foam cover 37 can envelope the microphone housing 36 and the microphone 35.

As disclosed herein, the microphone 35 is in electrical communication with the remaining electrical components of the modular headset 10, including the battery module 24 and the printed circuit board assembly 48. The electrical communication from the microphone 35 to the proximal end of the microphone boom assembly 22 and the speaker housing 26 can be achieved by any effective method that might now exist or hereafter be developed, including, for example, electrical wiring.

As is further illustrated in the exploded view of FIG. 5, the top cover assembly 54 can be considered to be founded on a shell 62. The shell 62 has approximately one-half of the slot for receiving the battery module 24 and a tapered tip portion for engaging the flexible boom key 28 and, derivatively, the microphone boom 22. A tubular hub 63 projects centrally from the shell 62 to establish a rotational axis disposed at a centerline thereof. The hub 63 has a keying configuration. In this case, the keying configuration comprises opposed longitudinally disposed channels in the hub 63, but it will be appreciated that other keying configuration are possible and within the scope of the invention.

In the embodiment of FIGS. 5 through 9, where active and inactive angular zones $Z_a$ and $Z_m$ are not provided, the tubular hub 63 has positive and negative electrical contact surfaces disposed over the circumference thereof. In this manifestation of the invention, the positive and negative electrical contact surfaces are formed by first and second electrically conductive rings 64 and 68 concentrically received over and retained by the hub 63. The rings 64 and 68 are keyed to the hub 63 through the opposed longitudinal channels in the hub 63 and inboard projections from the rings 64 and 68. It will be understood that other electrical contact surfaces are possible and within the scope of the invention, such as annular metal strips or any other electrical contact surfaces that can span all of or a portion of the periphery of the hub 63. The electrically conductive rings 64 and 68 are mechanically and electrically separated, such as by a non-conductive ring 66 interposed therebetween.

The speaker itself, referenced at 70, is round and is received and held within the annular hub 63. The speaker 70 can be covered by a panel 72, which can be round and formed from a waterproof material, such as a waterproof mesh. A speaker cover 74, which can have an aperture formation therein for facilitating audio transmission, can be engaged with and retained by the hub 63 by any effective mechanism, including threads, adhesive, welding, integral formation, or any other mechanism or combination thereof.

As shown, for instance, in FIGS. 1 through 4, the hub 63, and thus the retained electrical conductive rings 64 and 68, the speaker 70, and the speaker cover 74, can be received into and retained relative to an aperture in the headband 14. The aperture can be annular and can, for example, be disposed adjacent to an end portion of the U-shaped, resilient headband module 14. The hub 63 could be received into the aperture freely and could be selectively retained in place to pivot relative to the headband module 14. Alternatively, the hub 63 can be retained in a snap-fit engagement or other frictional and/or mechanical engagement between retaining features disposed on the hub 63 and, additionally or alternatively, the aperture in the headband module 14. By way of example and not limitation, the hub 63 and/or the headband module 14 could have one or more radially projecting protuberances, complete or partial rings, fingers, or any other retaining feature or combination thereof. As is illustrated in FIGS. 5 and 6, for example, the depicted embodiment of the hub 63 has an annular ring that projects therefrom such that the hub 63 and the speaker and microphone boom module 12 can be selectively retained relative to the aperture of the headband module 14 by a snap-fit engagement. The hub 63 and the speaker and microphone boom module 12 in general can be readily removed from the aperture in the headband module 14, such as by disengaging the snap-fit engagement.

It should be further understood that the hub 63 and the aperture could be oppositely disposed. More particularly, within the scope of the invention, the headband module 14 could have a hub disposed thereon, such as adjacent to one of the distal ends thereof, and the speaker and microphone boom module 12 could have an aperture therein for receiving the hub in a selectively pivotable engagement. In such embodiments, the conductive rings 64 and 68 could again be disposed on the hub 63 but now retained by the headband module 14. Such embodiments should be considered to be within the scope of the invention except as it might be expressly limited by the claims.

When the hub 63 is received and retained relative to the aperture in the headband module 14 or vice versa, a pivotable engagement is achieved between the speaker and microphone boom module 12 and the headband module 14. With that, the speaker and microphone boom module 12 can be disposed at substantially any angle relative to the headband module 14 to permit selective adjustment over a range of angles, and the speaker and microphone boom module 12 can be readily adjusted for use relative to the left and right ears of a user.

As FIGS. 6 through 10 illustrate, the headband module 14 retains electrical contacts 76 that project radially inward within the aperture in the headband module 14 to slide along the electrical contact surfaces presented by the electrically conductive rings 64 and 68 when the speaker and microphone boom module 12 and the headband module 14 are engaged. Moreover, the headband module 14, the speaker and microphone boom module 12, or some combination thereof can include a locking mechanism 20 for selectively locking the speaker and microphone boom module 12 against pivoting relative to the headband module 14. The electrical contacts 76 could be retained and configured in numerous ways, and the locking mechanism 20 for selectively locking the speaker and microphone boom module 12 against relative pivoting could similarly be carried out in multiple different ways, each within the scope of the present invention except as it might be expressly limited by the claims.

In the depicted embodiment, there are four electrical contacts 76 that are resiliently retained and biased to ride against the rings 64 and 68 with first and second contacts 76 sliding along the ring 64 and first and second contacts 76 sliding along the ring 68. The contacts 76 could, for example, comprise telescoping conductive members so that the contacts 76 are resiliently extendable and retractable. Additionally or alternatively, the contacts 76 could be retained by a resilient member or members. Here, the electrical contacts 76 are supported by first and second spring PCB holders 78, and the contacts 76 and the holders 78 are in turn supported by a bracket 80 with a curved portion for being disposed adjacent to a portion of the hub 63. As shown, for instance, in FIG. 7, the bracket 80 is fixed in place relative to the headband module 14 with the curved portion thereof disposed to be generally concentric with the hub 63 when the headband module 14 and the speaker and microphone boom module 12 are engaged.

Figure 13:
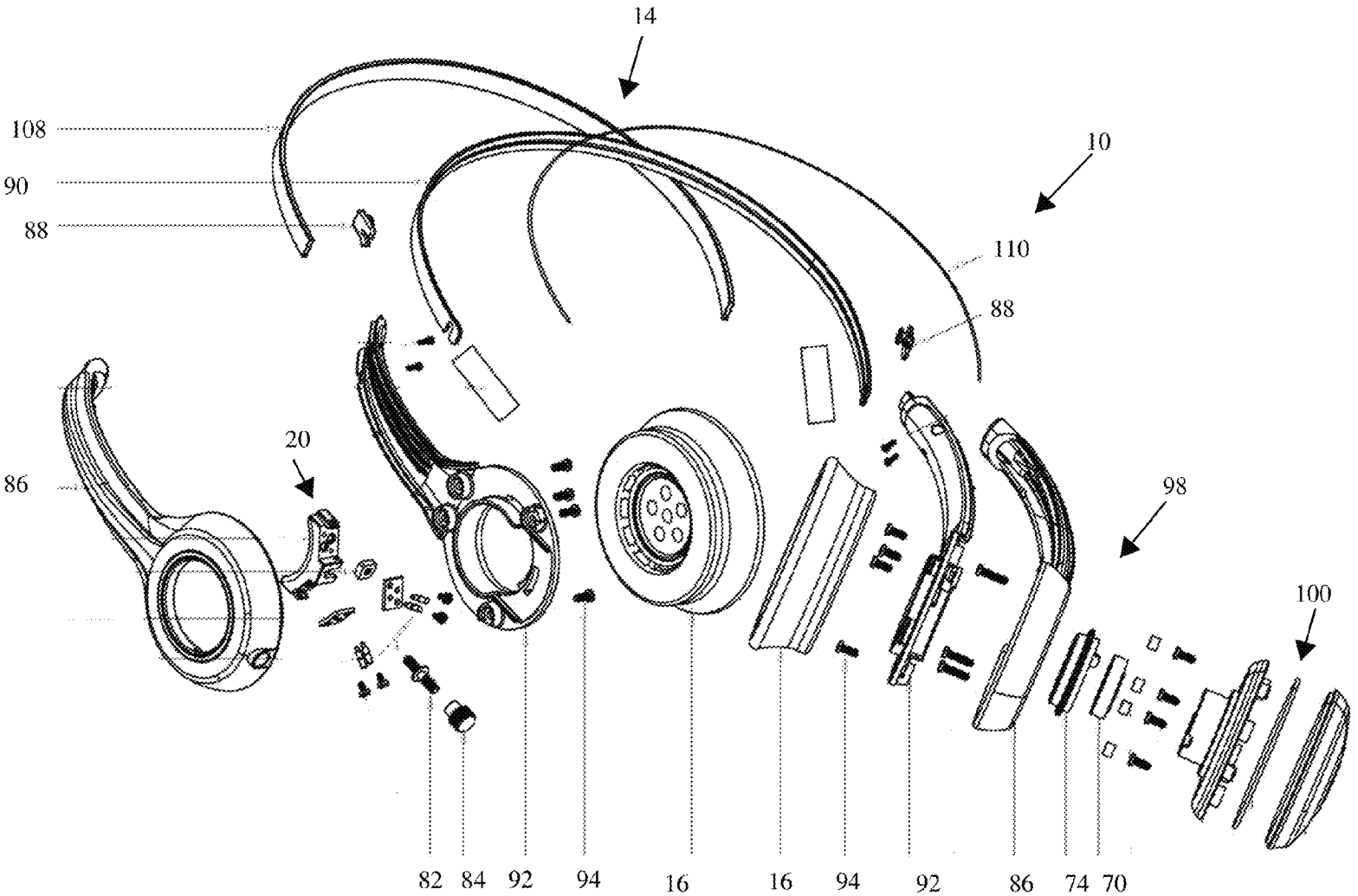
FIG. 13 is an exploded perspective view of a binaural modular headset.
Figure 14:
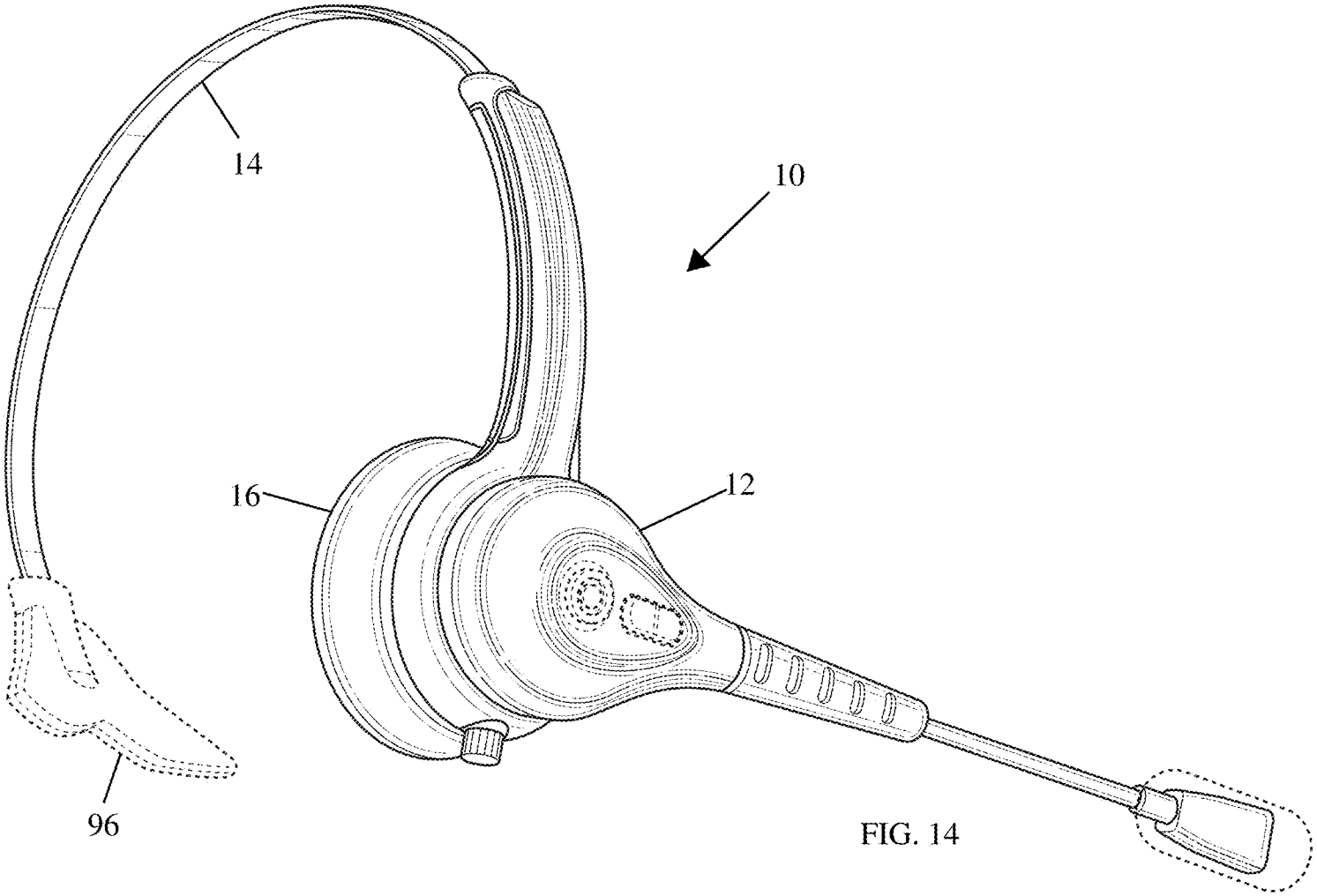
FIG. 14 is a perspective view of a monaural modular headset.

With the contacts 76 in electrical communication with the rings 64 and 68, power, audio communication, and other electrical transmissions can be made between the headband module 14 and the speaker and microphone boom module 12 without a need for a wired connection therebetween. Among other things, the electrical communication permits audio, electrical, and other communication to be had between the speaker and microphone boom module 12 and the headband module 14 and, potentially, in relation to a second speaker assembly 98 as by wiring 110 communicating along the resilient band 90 of the headband module 14 as shown in FIG. 13.

Where the rings 64 and 68 are complete rings as in FIGS. 5 through 9, for instance, the contacts 76 will make continuous contact with the rings 64 and 68 throughout the entire range of pivoting of the speaker and microphone boom module 12 relative to the headband module 14, and electrical communication will be constant without regard to the orientation of the speaker and microphone boom module 12. However, embodiments of the modular headset 10 are contemplated with configurations as in FIGS. 15 through 17 where operative electrical contact between the contacts 76 and either or both of the positive and negative electrical contact surfaces, such as the rings 64 and 68, disposed over the peripheral surface of the hub 63 is discontinuous over one or more zones of angular positioning of the speaker and microphone boom module 12 relative to the headband module 14. With that, as is illustrated in FIGS. 1 through 3 and 15 through 17, one or more active angular zones $Z_a$ and one or more inactive or mute angular zones $Z_m$ will be created. In the active angular zones $Z_a$, electrical communication is provided between the speaker and microphone boom module 12 and the headband module 14. In the mute angular zones $Z_m$, electrical communication between the speaker and microphone boom module 12 and the headband module 14 is automatically prevented. The discontinuity of either or both electrical contact surfaces could be achieved in a plurality of ways, each within the scope of the invention except as may be expressly limited by the claims.

Figure 15:
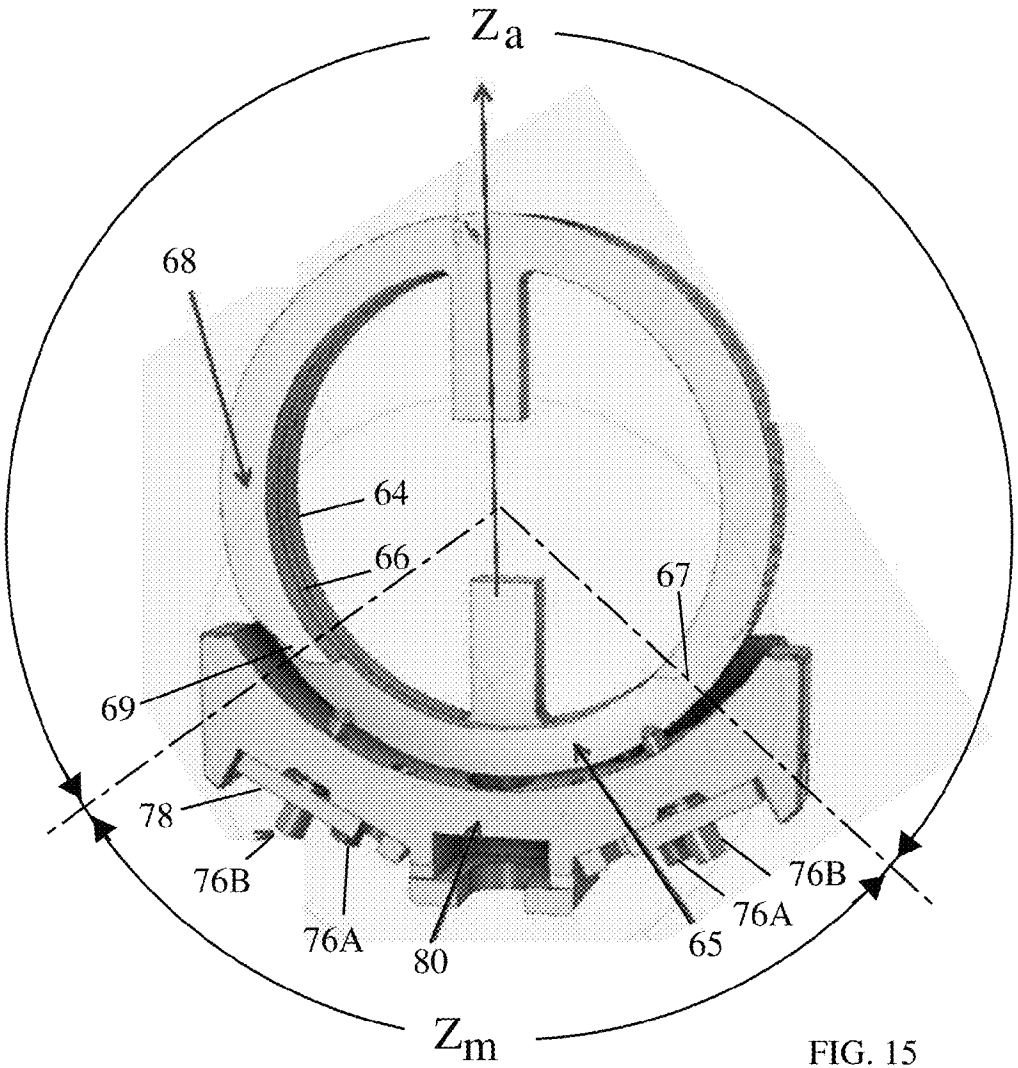
FIG. 15 is a perspective view of a sliding, rotatable electrical contact for the modular headset with automatic angular muting.
Figure 16:
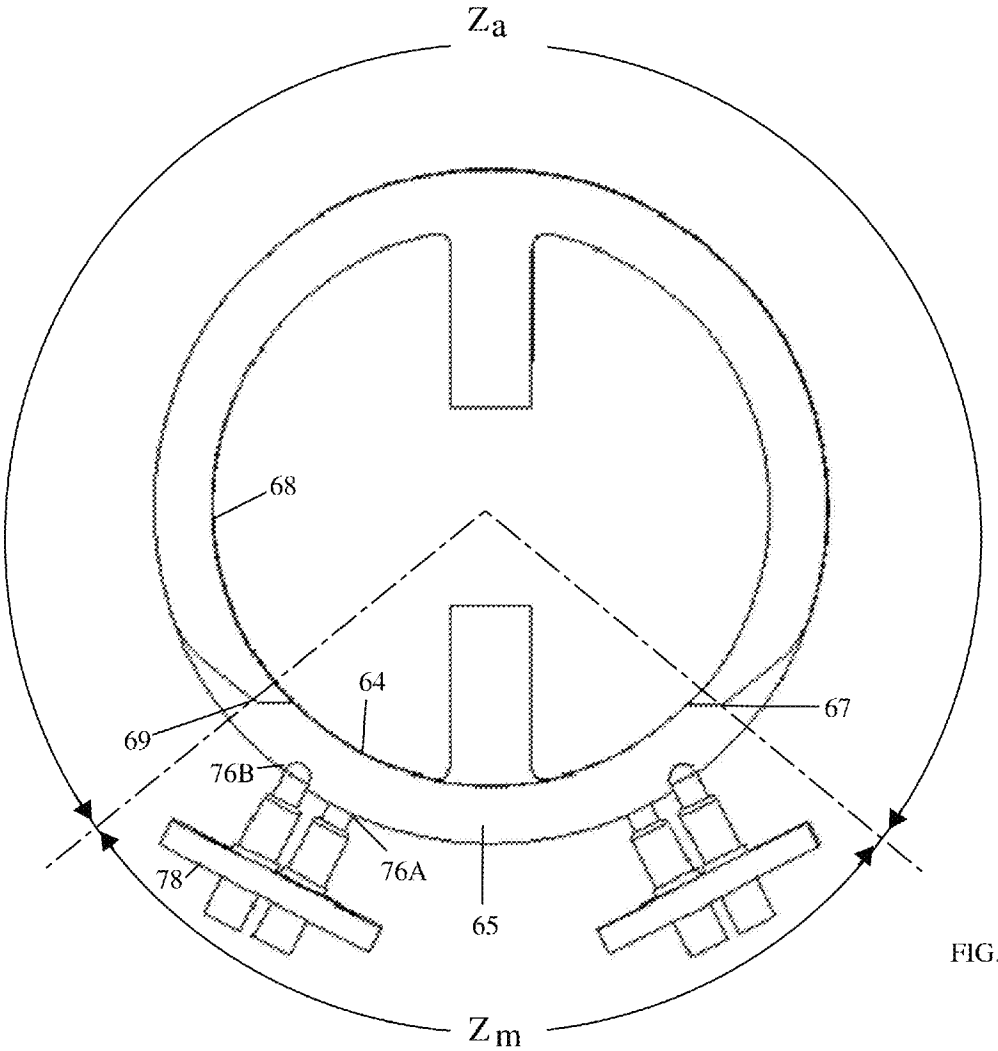
FIG. 16 is a view in front elevation of a portion of the sliding, rotatable electrical contact for the modular headset with automatic angular muting.
Figure 17:
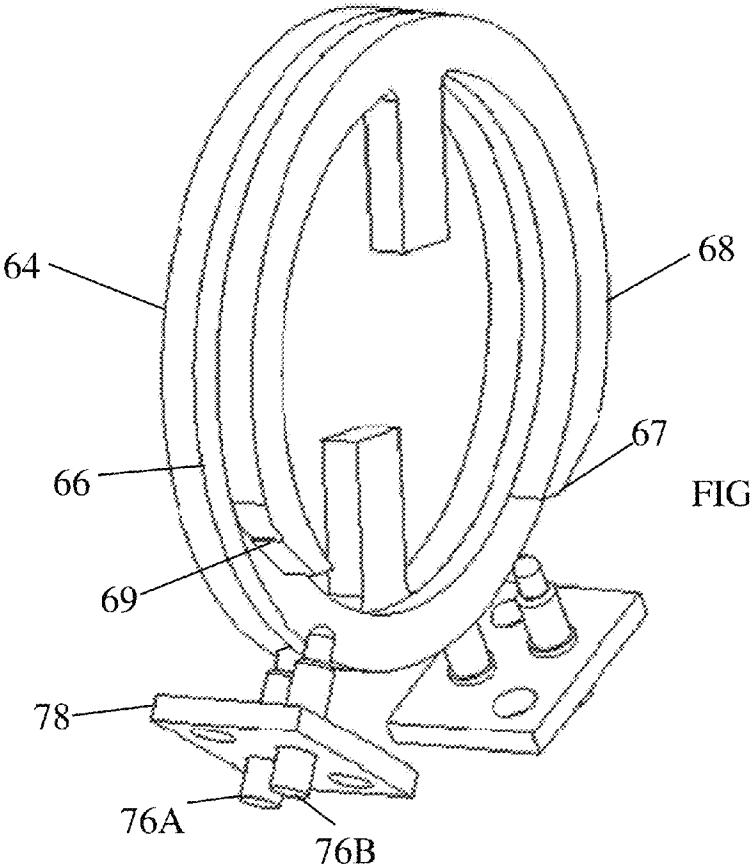
FIG. 17 is a perspective view of a portion of the sliding, rotatable electrical contact for the modular headset with automatic angular muting.

In the manifestation of FIGS. 15 through 17, the electrical discontinuity is produced by a gap 65 in the second conductive ring 68 such that a segment of the circle along which the remainder of the second ring 68 is disposed is open. The second conductive ring 68 has sloped end portions 67 and 69 contiguous with the gap 65. As shown in FIG. 15, two first ring electrical contacts 76A are retained by the bracket 80 to slide along the first ring 64, and two second ring electrical contacts 76B are retained by the bracket 80, which itself is retained by the speaker and microphone boom module 12, to slide along the second ring 68. As a result, when the speaker and microphone boom module 12 is rotated over a given angular range $Z_m$, electrical contact between the second ring electrical contacts 76B and the second ring 68 is lost as the second ring electrical contacts 76B travel through the gap 65 in the second ring 68. The microphone 35 is thus automatically muted over the inactive or mute angular range $Z_m$. When the speaker and microphone boom module 12 is rotated over a second angular range $Z_a$, the second ring electrical contacts 76B will contact and slide along the second ring 68 thereby permitting electrical communication between the speaker and microphone boom module 12 and the headband module 14 and operation of the microphone 35. As the second ring electrical contacts 76B transition from the gap 65 to travel over the second ring 68, they are permitted to ride smoothly up the sloped end portions 67 and 69.

With the rings 64 and 68 and the electrical contacts 76A and 76B configured as in FIGS. 15 through 17, automatic switching is permitted between an active mode where audio signals are received and transmitted by the speaker and microphone boom module 12 and an inactive or mute mode where the speaker and microphone boom module 12 are automatically deactivated and audio signals from the wearer are not received and transmitted. The automatic switching of the speaker and microphone boom module 12 between active mode and mute mode is dependent on the angular orientation of the speaker and microphone boom module 12 in relation to the headband module 14. The automated switching establishes one active angular zone $Z_a$ of pivoting wherein the speaker and microphone boom module 12 is active and one mute angular zone $Z_m$ of pivoting wherein the speaker and microphone boom module 12 is rendered inactive or mute. The number, locations, and spans of the zones $Z_a$ and $Z_m$ could vary. In the embodiments of FIGS. 1 through 3 and 15 through 17, for example, the inactive angular zone $Z_m$ spans approximately 60 degrees and is centered around alignment with the longitudinal of the speaker and microphone boom module 12 with the plane of the headband module 14, and the active angular zone $Z_a$ spans the approximately 300 degrees therebetween.

A wearer of the modular headset 10 with the active and inactive zones $Z_a$ and $Z_m$ can thus be provided with active audio communication when the speaker and microphone boom module 12 is oriented in any portion of the active angular zone $Z_a$. A wearer can induce the speaker and microphone boom module 12 to an inactive, mute mode simply by pivoting the speaker and microphone boom module 12 to have a longitudinal orientation within the inactive angular zone $Z_m$. For example, with the active and inactive zones $Z_a$ and $Z_m$ disposed as shown and described, the wearer could have the speaker and microphone boom module 12 disposed in a use orientation as in FIG. 1 where the modular headset 10 is configured for use with the speaker and microphone boom module 12 to the right of the wearer's head or with the speaker and microphone boom module 12 pivoted to be oppositely disposed relative to the headband module 14. When desired, the wearer can simply pivot the speaker and microphone boom module 12 into general alignment with the headband module 14, such as by flipping the speaker and microphone boom module 12 upwardly thereby to induce the headset 10 into a mute mode.

A better understanding of the structure of an embodiment of the headband module 14 can be had by further reference to FIG. 13 with it being understood that alternative embodiments are readily possible and within the scope of the invention. In any event, the depicted headband module 14 has a U-shaped, resilient D-band 90 with first and second ends. A headband casing 108 can partially or completely encase or overlap the D-band 90. Where the modular headset 10 is binaural as in FIG. 13, a wire 110 can, in combination with the electrical contacts 76 and the rings 64 and 68, electrically couple the speaker and microphone boom module 12 and a second speaker assembly 98.

A headband outer cover 86 and a headband inner cover 92 have corresponding shapes and are joined to receive and retain the first end of the D-band 90. The covers 86 and 92 together define the aperture for receiving the hub 63 of the speaker and microphone boom module 12 and receive and retain the bracket 80, the electrical contacts 76, and the locking mechanism 20. Where the modular headset 10 is binaural, a headband outer cover 86 and a headband inner cover 92 again having corresponding shapes can be joined to receive and retain the first end of the D-band 90 as FIG. 13 illustrates. The covers 86 and 92 can again retain an ear cushion 16 and can define an aperture for receiving an earpiece housing 100 with a speaker 70 and a speaker cover 74. A headband ratchet 88 further engages the end of the D-band 90. The bracket 80 of the locking mechanism 20 is fixed in place between the inner and outer covers 92 and 86 when the covers 92 and 86 are joined, such as by fasteners 94, adhesive, or any other method of combination thereof. An ear cushion 16 is retained relative to each set of covers 86 and 92, such as by a lip disposed on the inner cover 92. Where the modular headset 10 pursues a one-earphone, monaural configuration, a pad 96 can be retained at the second end of the D-band 90 as in FIG. 2.

The locking mechanism 20 for selectively locking the speaker and microphone boom module 12 against pivoting relative to the headband module 14 can additionally function to retain the hub 63 within the aperture of the headband module 14. As shown in FIGS. 6 through 10, for example, the locking mechanism 20 could comprise a setscrew 82 that is threadedly engaged with the bracket 80. The bracket 80 is in turn fixed in relation to the headband module 14. The setscrew 82, which can have a knurled handle 84, is radially aligned with the hub 63. With that, sufficient rotation of the setscrew 82 in a first rotational direction, such as clockwise, will tend to lock the hub 63 and thus the speaker and microphone boom module 12 against pivoting relative to the headband module 14, and rotation of the setscrew 82 in a second rotational direction, such as counter-clockwise, will tend to free the hub 63 and thus the speaker and microphone boom module 12 to pivot relative to the headband module 14. Accordingly, a user can quickly and conveniently free the speaker and microphone boom module 12 to pivot, adjust it to a desired orientation, and then fix it against pivoting, all by a simple rotation of the setscrew 82 or actuation of another selective locking mechanism.

Figure 18:
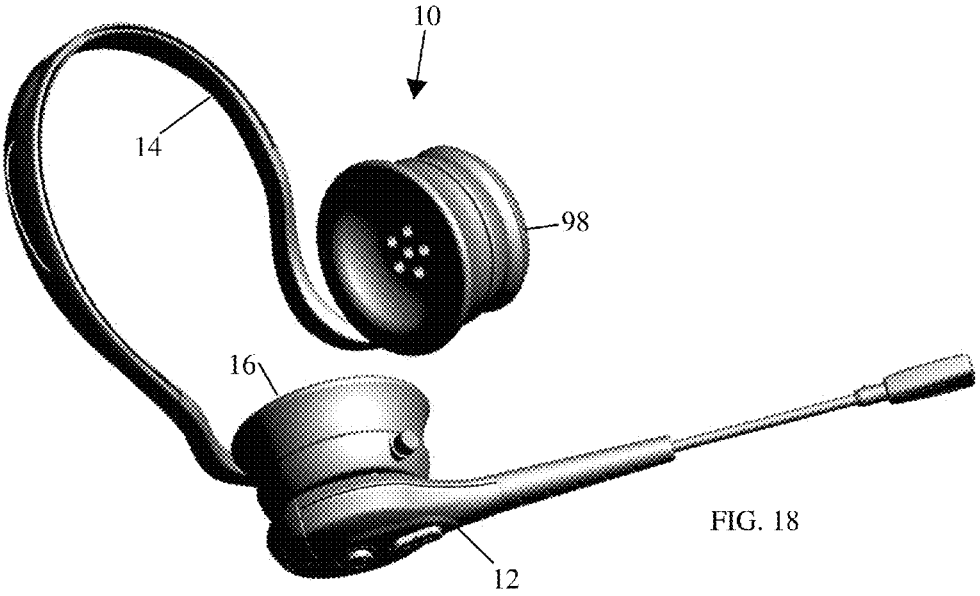
FIG. 18 is a perspective view of a modular headset with a behind-the-neck headband.
Figure 19:
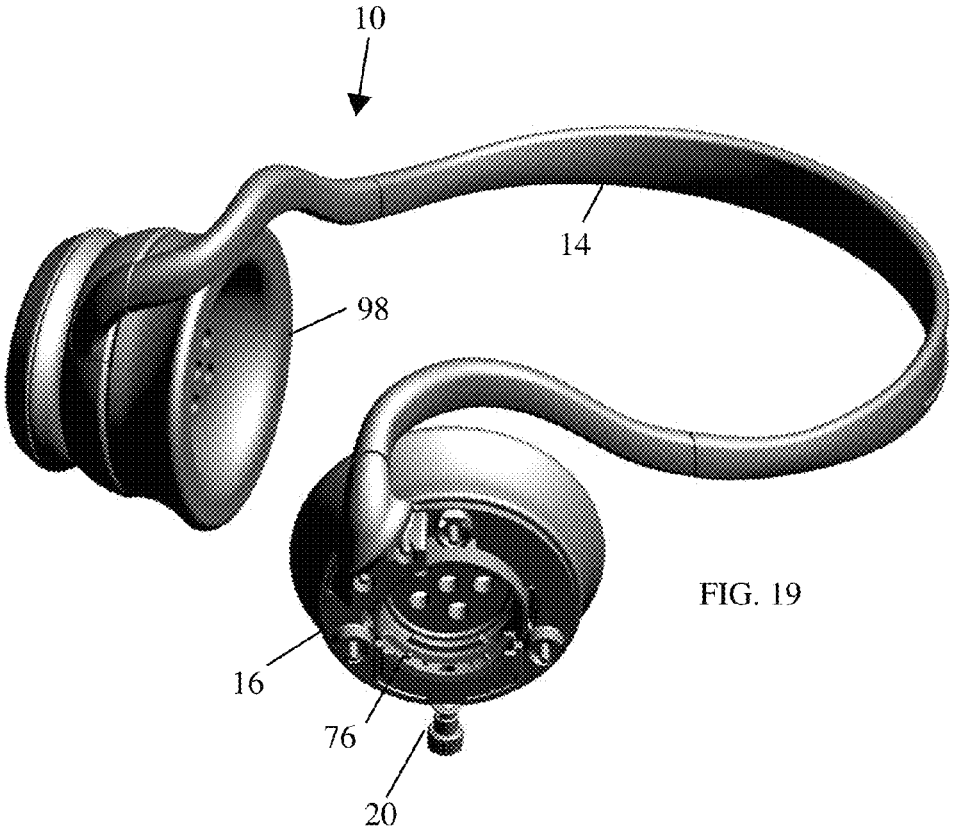
FIG. 19 is a perspective view of the behind-the-neck headband modular headset with the speaker and microphone boom module removed.
Figure 20:
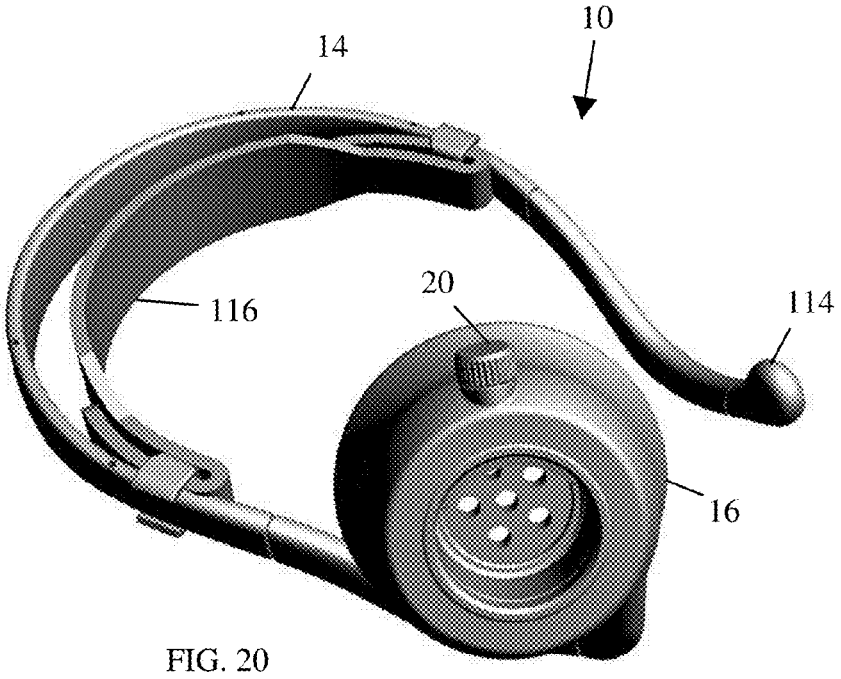
FIG. 20 is a perspective view of a further modular headset with a behind-the-neck headband.

The headband module 14 of the modular headset 10 could be differently configured within the scope of the invention. In the modular headset 10 as illustrated in FIGS. 18 through 20, for example, the headband module 14 and the modular headset 10 in general can be configured for the headband module 14 to pass behind the head or neck of the wearer. There, the headband module 14 is contoured with arcuate end portions that cause the central portion thereof to be disposed behind the head of the wearer rather than atop the head as in the embodiments previously shown. The headband module 14 could be supplemented by a retainer strap 116 that could be clipped to the central portion of the headband module 14. Such embodiments, again including a locking mechanism 20 and sliding contacts 76 with a pivotable speaker and microphone boom module 12, could be corded or cordless.

In view of the foregoing, it will be appreciated that those making use of an embodiment of the modular headset 10 can achieve a plurality of advantages. For instance, one can readily connect various headband modules 14 and speaker and microphone boom modules 12 for both mono and stereo applications while using the locking mechanism 20 to tighten the speaker and microphone boom module 12 to the headband module 14 quickly and effectively. Moreover, a user can rotate the speaker and microphone boom module 12 over a range of angles along a single axis within the headband module 14 to adjust the angle of use of the speaker and microphone boom module 12 and to switch from one ear to the other without losing electrical contact with the headband module 14 and, where applicable, a second speaker assembly 98. Even further, with a backup battery 50, the battery module 24 can be removed, such as for recharging or replacement, without an immediate loss in power.

It will be understood that the modular headset 10 could include additional or fewer components, functions, or characteristics than those shown and described herein. Accordingly, although the foregoing components and arrangements of components may indeed be preferable and advantageous in achieving one or more objects of the invention, the headset 10 shall not be interpreted to require all of the foregoing components, to be limited to the specified components, or to be limited even to the positioning and configuration of individual components except as the claims might expressly specify.

Therefore, with certain details and embodiments of the present invention for a modular headset 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. It must be further noted that a plurality of the following claims may express or be considered to express certain elements as means for performing a specific function, at times without the recital of structure or material. As the law demands, any such claims shall be construed to cover not only the corresponding structure and material expressly described in this specification but also all equivalents thereof.

We claim as deserving the protection of Letters Patent:

1. A modular headset comprising:

a microphone boom module with a microphone boom with a proximal portion and a distal portion and a microphone retained by the distal portion of the microphone boom;

a headband module;

a hub disposed on one of the headband module and the microphone boom module and an aperture in the other of the headband module and the microphone boom module for selectively receiving the hub in a pivotable engagement wherein the hub is annular;

positive and negative electrical contact surfaces disposed over at least a portion of the hub or the aperture wherein the positive and negative electrical contact surfaces comprise first and second conductive rings; and electrical contacts that project from the other of the hub and the aperture to travel along the positive and negative electrical contact surfaces when the microphone boom module and the headband module are engaged with the hub received in the aperture;

wherein the microphone boom module has an active mode and a mute mode and wherein the active and mute modes are dependent on the angular orientation of the microphone boom module in relation to the headband module wherein the microphone boom module has a first, active angular zone $Z_a$ of pivoting wherein the microphone boom module is active and a second, mute angular zone $Z_m$ of pivoting wherein the microphone boom module is rendered mute;

wherein at least one of the positive and negative electrical contact surfaces disposed over at least a portion of the hub or the aperture is discontinuous over a non-conductive angular portion, wherein the mute angular zone $Z_m$ is established by the non-conductive angular portion wherein the non-conductive angular portion is produced by a gap in at least the second conductive ring, and wherein the second conductive ring has sloped end portions contiguous with the gap.

2. The modular headset of claim 1 wherein the aperture is disposed in the headband module and the hub is retained by the microphone boom module.

3. The modular headset of claim 2 further comprising a speaker retained by the microphone boom module.

4. The modular headset of claim 1 wherein the electrical contacts are resiliently biased into contact with the annular positive and negative electrical contact surfaces wherein the electrical contacts comprise telescoping conductive members.

5. The modular headset of claim 1 further comprising a locking mechanism for selectively locking the hub against pivoting relative to the aperture and derivatively locking the microphone boom module against pivoting relative to the headband module.

6. The modular headset of claim 1 further comprising a battery module removably and replaceably received by the microphone boom module and a back-up battery disposed within the microphone boom module to provide temporary power in the event of a discharge or removal of the battery module.

7. The modular headset of claim 1 characterized in that the inactive angular zone $Z_m$ is substantially centered around alignment with the longitudinal of the speaker and microphone boom module with the plane of the headband module, and the active angular zone $Z_a$ spans therebetween.

8. The modular headset of claim 7 characterized in that the inactive angular zone $Z_m$ spans approximately 60 degrees and the active angular zone $Z_a$ spans the approximately 300 degrees therebetween.

9. The modular headset of claim 1 characterized in that the inactive angular zone $Z_m$ spans approximately 60 degrees and the active angular zone $Z_a$ spans the approximately 300 degrees therebetween.

10. A modular headset comprising:

a microphone boom module with a microphone boom with a proximal portion and a distal portion and a microphone retained by the distal portion of the microphone boom;

a headband module;

a annular hub disposed on one of the headband module and the microphone boom module and an aperture in the other of the headband module and the microphone boom module for selectively receiving the hub in a pivotable engagement wherein the hub is annular;

positive and negative electrical contact surfaces disposed over at least a portion of the hub or the aperture;

electrical contacts that project from the other of the hub and the aperture to travel along the positive and negative electrical contact surfaces when the microphone boom module and the headband module are engaged with the hub received in the aperture; and a locking mechanism for selectively locking the hub against pivoting relative to the aperture and derivatively locking the microphone boom module against pivoting relative to the headband module wherein the locking mechanism comprises a setscrew threadedly engaged with the aperture that selectively engages the hub.

11. The modular headset of claim 10 wherein the microphone boom module has an active mode and a mute mode and wherein the active and mute modes are dependent on the angular orientation of the microphone boom module in relation to the headband module.

12. The modular headset of claim 11 wherein the microphone boom module has a first, active angular zone $Z_a$ of pivoting wherein the microphone boom module is active and a second, mute angular zone $Z_m$ of pivoting wherein the microphone boom module is rendered mute.

13. The modular headset of claim 12 wherein there is one active angular zone $Z_a$ and one mute angular zone $Z_m$.

14. The modular headset of claim 12 wherein the microphone boom module has a longitudinal orientation, wherein the headband module has a headband disposed generally in a plane, and wherein the mute angular zone $Z_m$ includes a range of angles encompassing alignment of the longitudinal orientation of the microphone boom module with the plane of the headband.

15. The modular headset of claim 12 wherein at least one of the positive and negative electrical contact surfaces disposed over at least a portion of the hub or the aperture is discontinuous over a non-conductive angular portion and wherein the mute angular zone $Z_m$ is established by the non-conductive angular portion.

16. The modular headset of claim 15 wherein the positive and negative electrical contact surfaces comprise first and second conductive rings.

17. The modular headset of claim 16 wherein the non-conductive angular portion is produced by a gap in at least one of the first and second conductive rings.

18. The modular headset of claim 17 wherein the first conductive ring is continuous and wherein the gap is in the second conductive ring.

19. A modular headset comprising:

a microphone boom module with a microphone boom with a proximal portion and a distal portion and a microphone retained by the distal portion of the microphone boom;

a headband module;

a hub disposed on one of the headband module and the microphone boom module and an aperture in the other of the headband module and the microphone boom module for selectively receiving the hub in a pivotable engagement wherein the hub is annular;

positive and negative electrical contact surfaces disposed over at least a portion of the hub or the aperture; and electrical contacts that project from the other of the hub and the aperture to travel along the annular positive and negative electrical contact surfaces when the microphone boom module and the headband module are engaged with the hub received in the aperture;

a locking mechanism for selectively retaining the hub within the aperture wherein the locking mechanism comprises a bracket retained within the aperture wherein the bracket is selectively operable to fix the hub within the aperture by rotation of a setscrew.

20. The modular headset of claim 19 further comprising a first speaker retained by the microphone boom module, wherein the headband module has a first end portion and a second end portion, and wherein the modular headset is binaural with a second speaker retained by the second end portion of the headband module in electrical communication with the first speaker.

21. The modular headset of claim 20 wherein the aperture is disposed in the headband module and the hub is retained by the microphone boom module.

22. The modular headset of claim 19 characterized in that the aperture is disposed in the headband module and the hub is retained by the microphone boom module.

23. The modular headset of claim 19 characterized in that the hub and the aperture are further engageable in a snap-fit engagement.

* * * * *